US007494960B2

(12) United States Patent
Migdal et al.

(10) Patent No.: US 7,494,960 B2
(45) Date of Patent: Feb. 24, 2009

(54) LUBRICANT COMPOSITIONS COMPRISING AN ANTIOXIDANT BLEND

(75) Inventors: Cyril A. Migdal, Pleasant Valley, NY (US); David J. Sikora, Middlebury, CT (US)

(73) Assignee: Crompton Corporation, Middlebury, CT (US)

( * ) Notice: Subject to any disclaimer, the term of this patent is extended or adjusted under 35 U.S.C. 154(b) by 427 days.

(21) Appl. No.: 10/771,907

(22) Filed: Feb. 3, 2004

(65) Prior Publication Data

US 2005/0170978 A1 Aug. 4, 2005

(51) Int. Cl.
*C10M 107/34* (2006.01)
*C10M 105/36* (2006.01)

(52) U.S. Cl. ..... 508/497; 508/465

(58) Field of Classification Search ..... 508/497, 508/496, 465, 463, 459, 110, 100
See application file for complete search history.

(56) References Cited

U.S. PATENT DOCUMENTS

| | | | | |
|---|---|---|---|---|
| 5,091,099 | A | 2/1992 | Evans et al. | |
| 5,498,809 | A | 3/1996 | Emert et al. | 585/13 |
| 5,523,007 | A | 6/1996 | Kristen et al. | 252/32.7 |
| 6,559,105 | B2 | 5/2003 | Abraham et al. | 508/186 |
| 6,887,835 | B1 * | 5/2005 | Migdal et al. | 508/204 |
| 2002/0006878 | A1 | 1/2002 | Abraham et al. | |
| 2004/0147414 | A1 * | 7/2004 | Migdal et al. | 508/365 |
| 2005/0176594 | A1 * | 8/2005 | Grabowski et al. | 508/215 |
| 2006/0122295 | A1 * | 6/2006 | Oysaed et al. | 524/128 |

FOREIGN PATENT DOCUMENTS

| | | | |
|---|---|---|---|
| EP | 0896050 | A1 | 2/1999 |
| EP | 1054052 | A2 * | 11/2000 |
| WO | WO01/59041 | A1 | 8/2001 |
| WO | WO01/60959 | A1 | 8/2001 |
| WO | WO2005/023886 | A1 * | 3/2005 |
| WO | WO 2005023886 | A1 * | 3/2005 |

* cited by examiner

*Primary Examiner*—Todd E Manahan
*Assistant Examiner*—Amy T Lang
(74) *Attorney, Agent, or Firm*—Jaimes Sher

(57) ABSTRACT

A composition is disclosed that comprises a lubricant and at least a first antioxidant and a second antioxidant, the first antioxidant being a hindered phenolic and the second antioxidant being a thioether. Also disclosed is a method of increasing the oxidation stability of a lubricant comprising adding thereto at least a first antioxidant and a second antioxidant, the first antioxidant being a hindered phenolic and the second antioxidant being a thioether.

18 Claims, No Drawings

LUBRICANT COMPOSITIONS COMPRISING AN ANTIOXIDANT BLEND

BACKGROUND OF THE INVENTION

1. Field of the Invention

The present invention is related to the improvement in oxidation stability of lubricants and, more particularly, to the oxidation stability of lubricating oils by a combination of at least two antioxidants.

2. Description of Related Art

Lubricating oils, as used in the internal combustion engines of automobiles, trucks, trains, ships, and aviation turbine oils of jet aircraft, are subjected to a demanding environment during use. This environment results in the oxidation of the oil, which oxidation is catalyzed by impurities that are present in the oil, e.g., iron compounds, and further promoted by the elevated temperatures that arise during use. This oxidation of lubricating oils during use is usually controlled, at least to some extent, by the addition of antioxidants that may extend the useful life of the oil.

U.S. Pat. No. 5,523,007 discloses a lubricant oil composition comprising a diesel engine lubricating oil and, as antioxidant, a compound of the formula:

I

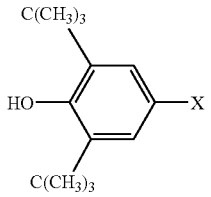

wherein $R^1$ and $R^2$ are each independently of the other $C_1$-$C_{12}$ alkyl and X is

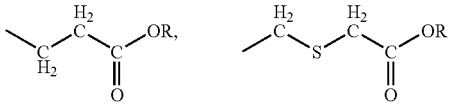

or —$CH_2$—S—R and R is a straight chain or branched alkyl radical of the formula —$C_nH_{2n+1}$, wherein n is an integer from 8 to 22.

U.S. Pat. No. 6,559,105 discloses a composition of an antioxidant of the formula:

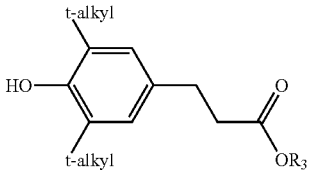

where $R^3$ is an alkyl group of 2 to 6 carbon atoms, and a dispersant or a detergent, is a useful additive package for lubricant compositions.

The disclosures of the foregoing are incorporated herein by reference in their entirety.

SUMMARY OF THE INVENTION

It has now been discovered that a combination of at least one phenolic and at least one thioether is highly effective in inhibiting oxidation in lubricant oil compositions. The hindered phenolic acts synergistically with the thioether to provide a significant improvement in oxidation control.

More particularly, the present invention is directed to a composition comprising a lubricant and at least a first antioxidant and a second antioxidant, the first antioxidant being a hindered phenolic and the second antioxidant being a thioether.

In another aspect, the present invention is directed to a method of increasing the oxidation stability of a lubricant comprising adding thereto at least a first antioxidant and a second antioxidant, the first antioxidant being a hindered phenolic and the second antioxidant being a thioether.

DESCRIPTION OF THE PREFERRED EMBODIMENTS

In accordance with the present invention, a combination of hindered phenolic and thioethers has been discovered that is highly effective in inhibiting oxidation in lubricant oil compositions. The hindered phenolic acts synergistically with thioethers to provide significant improvement in oxidation control.

Lubricant compositions containing various hindered phenolics are widely known in the art. Less widely known is the use of thioethers in lubricant compositions. The present invention is directed to a specific optimum blend of hindered phenolic antioxidant and thioether that is a unique composition previously unknown in the art.

Preferred examples of sterically hindered phenols that are useful in the practice of the present invention include 2,4-dimethyl-6-octyl-phenol; 2,6-di-t-butyl-4-methyl phenol (i.e., butylated hydroxy toluene); 2,6-di-t-butyl-4-ethyl phenol; 2,6-di-t-butyl-4-n-butyl phenol; 2,2'-methylenebis(4-methyl-6-t-butyl phenol); 2,2'-methylenebis(4-ethyl-6-t-butyl phenol); 2,4-dimethyl-6-t-butyl phenol; 4-hydroxymethyl-2,6-di-t-butyl phenol; n-octadecyl-beta(3,5-di-t-butyl-4-hydroxyphenyl)propionate; 2,6-dioctadecyl-4-methyl phenol; 2,4,6-trimethyl phenol; 2,4,6-triisopropyl phenol; 2,4,6-tri-t-butyl phenol; 2-t-butyl-4,6-dimethyl phenol; 2,6-methyl-4-didodecyl phenol; tris(3,5-di-t-butyl-4-hydroxy isocyanurate, and tris(2-methyl-4-hydroxy-5-t-butylphenyl)butane, Preferred are octadecyl-3,5-di-t-butyl-4-hydroxy hydrocinnamate (NAUGARD 76, Crompton Corp.); tetrakis{methylene(3,5-di-t-butyl-4-hydroxy-hydrocinnamate)}methane (NAUGARD 10, Crompton Corp.); 2,2'-oxamido bis{ethyl-3-(3,5-di-t-butyl-4-hydroxyphenyl}Propionate (NAUGARD XL-1,Crompton Corp.); 1,2-bis(3,5-di-t-butyl-4-hydroxyhydrocinnamoyl) hydrazine (IRGANOX MD 1024, Ciba Specialty Chemicals); 1,3,5-tris(3,5-di-t-butyl-4-hydroxybenzyl)-s-triazine-2,4,6 (1H,3H,5H)trione (IRGANOX 3114, Ciba Specialty Chemicals); 1,3,5-tris(4-t-butyl-3-hydroxy-2,6-dimethyl-benzyl)-s-triazine-2,4,6-(1H,3H,5H)trione (CYANOX 1790, American Cyanamid Co.); 1,3,5-trimethyl-2,4,6-tris(3,5-di-t-butyl-4-hydroxybenzyl)benzene (ETHANOX 330, Albemarle Corp.); 3,5-di-t-butyl-4-hydroxyhydrocinnamic acid triester with 1,3,5-tris(2-hydroxyethyl)-5-triazine-2,4,6(1H,3H,5H)-trione; bis(3,3-bis(4-hydroxy-3-t-butylphenyl)butanoic acid)glycolester; esters of $C_7$-$C_9$ branched alcohols with 3,5-di-tert.-butyl-4-hydroxyphenyl)propionic acid (Naugalube 532 from Crompton Corp., Iganox 135 from Ciba Specialty Chemicals) and esters of $C_{13}$-$C_{15}$ branched alcohols with 3,5-di-tert.-butyl-4-hydroxyphenyl)propionic acid (Durad AX-38, Great Lakes Chemical Corp.).

More preferred are the hindered phenols having molecular weights above 700, especially polyphenols that contain three or more substituted phenol groups, such as tetrakis{methylene (3,5-di-t-butyl-4-hydroxy-hydrocinnamate)}methane and 1,3,5-trimethyl-2,4,6-tris(3,5-di-t-butyl-4-hydroxybenzyl)benzene; and hindered phenols that are esters of $C_7$-$C_9$ branched alcohols with 3,5-di-tert.-butyl-4-hydroxyphenyl)propionic acid and esters of $C_{13}$-$C_{15}$ branched alcohols with 3,5-di-tert.-butyl-4-hydroxyphenyl) propionic acid.

The most preferred hindered phenolic for use in the practice of the present invention is butyl-3-(3,5-di-tert.-butyl-4-hydroxyphenyl)propionate.

The thioether employed in the practice of the present invention is preferably a dialkylthiodipropionate of the structure:

1

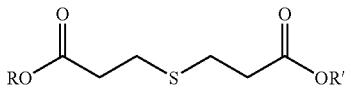

wherein R and R' are independently selected from the group consisting of straight chain and branched chain alkyl groups. Preferably, the alkyl groups comprise from 1 to 24 carbon atoms, more preferably from 8 to 18 carbon atoms. Most preferably, R and R' are the same and comprise 13 carbon atoms, i.e., ditridecylthiodipropionate.

In particular, the hindered phenolic butyl-3-(3,5-di-tert-butyl-4-hydroxyphenyl)propionate (Formula 2) antioxidant is a waxy solid at room temperature.

2

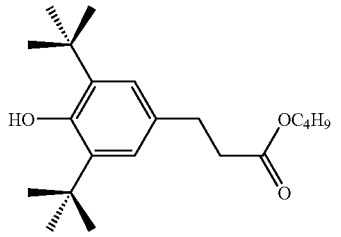

In addition to its excellent antioxidant activity, a unique feature of this blend is that through the appropriate ratio of the antioxidant of formula 2 and the thioether (ditridecylthiodipropionate) of formula 1, one can make a liquid product. Other attempts to make a liquid concentrate of the antioxidant of formula 2 of greater than 40% concentrate have been unsuccessful. However, in accordance with the present invention, the thioether in formula 1 is a perfect fluid to dissolve and keep dissolved at low temperatures (0° C.) the phenolic antioxidant of formula 2.

The preferred weight ratio is 30-70% antioxidant of formula 2 and 70-30% of the antioxidant of formula 1 in a blend. The most preferred weight ratio is 55% of the antioxidant of formula 2 and 45% of the antioxidant of formula 1. The range for this antioxidant mixture as formulated into a furnished lubricant is preferably 0.05-10.0 wt %, more preferably 0.1-5.0 wt %, most preferably 0.5-2 wt %.

The combination of antioxidant additives of this invention can be used in combination with other additives typically found in lubricating oils, as well as other antioxidants. The additives typically found in lubricating oils are, for example, dispersants, detergents, rust inhibitors, antioxidants, metal deactivators, anti-wear agents, anti-foamants, friction modifiers, seal swell agents, demulsifiers, viscosity index (VI) improvers, pour point depressants, and the like. See, e.g., U.S. Pat. No. 5,498,809 for a description of useful lubricating oil composition additives, the disclosure of which is incorporated herein by reference in its entirety.

Examples of dispersants include polyisobutylene succinimides, polyisobutylene succinate esters, Mannich Base ashless dispersants, and the like. Examples of detergents include metallic phenates, metallic sulfonates, metallic salicylates, and the like. Examples of antioxidants include alkylated diphenylamines, N-alkylated phenylenediamines, hindered phenolics, alkylated hydroquinones, hydroxylated thiodiphenyl ethers, alkylidenebisphenols, oil soluble copper compounds, and the like. Examples of anti-wear additives that can be used in combination with the additives of the present invention include organo borates, organo phosphites, organic sulfur-containing compounds, zinc dialkyldithiophosphates, zinc diaryldithiophosphates, phosphosulfurized hydrocarbons, and the like. Examples of friction modifiers include fatty acid esters and amides, organo molybdenum compounds, molybdenum dialkylthiocarbamates, molybdenum dialkyl dithiophosphates, and the like. An example of an anti-foamant is polysiloxane and the like. An example of a rust inhibitor is a polyoxyalkylene polyol and the like. Examples of VI improvers include olefin copolymers and dispersant olefin copolymers and the like. An example of a pour point depressant is polymethacrylate and the like.

Lubricant Compositions

Compositions, when they contain these additives, are typically blended into the base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1-12 | 1-4 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agent | 0.001-0.1 | 0.001-0.01 |
| Anti-wear Agent | 0.001-5 | 0.001-1.5 |
| Seal Swellant | 0.1-8 | 0.1-4 |
| Friction Modifier | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of the present invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and/or by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, about 2.5 to about 90 percent, preferably about 15 to about 75 percent, and more preferably about 25 to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocrackate base stocks produced by hydrocracking (rather than solvent extracting) the aromatic and polar components of the crude. Natural lubricating oils include animal oils, vegetable oils (e.g., rapeseed oils, castor oils, and lard oil), petroleum oils, mineral oils, and oils derived from coal or shale.

Synthetic oils include hydrocarbon oils and halo-substituted hydrocarbon oils, such as polymerized and interpolymerized olefins, alkylbenzenes, polyphenyls, alkylated diphenyl ethers, alkylated diphenyl sulfides, as well as their derivatives, analogs, homologues, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{18}$ monocarboxylic acids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricants, preferably lubricating oil compositions, as well as in fuel oil compositions. The additives can be included in a variety of oils with lubricating viscosity, including natural and synthetic lubricating oils and mixtures thereof The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Bulk oxidation runs were conducted using the nitro-oxidation test (UNOT) at 150° C. In all cases, a heavy duty diesel engine oil was used. All runs were conducted with carbon black (CB) present to simulate soot in the engine oil. All oils were tested under the following conditions:

| Test Conditions: | |
|---|---|
| Temperature: | 150° C. |
| Stirring Speed: | 500 rpm |
| $N_2$ Flow (8000 ppm NO): | 100 mL/min |
| Air flow (dry) | 200 mL/min |
| Fe Catalyst: | 500 μL |

Mixtures of butyl-3-(3,5-di-tert-butyl-4-hydroxyphenyl) propionate and Ditridecylthiodipropionate (Naugard® DTDTDP) were studied and compared to thiodiethylene bis (3,5-di-tert-butyl-4-hydroxyhydrocinnamate) (Durad® AX-15; Great Lakes Chemical). The case was studied in which the mixture of butyl-3-(3,5-di-tert-butyl-4-hydroxyphenyl) propionate and ditridecylthiodipropionate was adjusted to provide the same number of moles of phenolic and sulfide to the oil as would be provided by 1 weight percent of thiodiethylene bis (3,5-di-tert-butyl-4-hydroxyhydrocinnamate) (UNOT #153 & 154). This mole-adjusted mixture gave performance as good as thiodiethylene bis (3,5-di-tert-butyl-4-hydroxthydrocinnamate) at equal moles. The ditridecylthiodipropionate at 1 weight percent is not as effective alone as it is in combination with the hindered phenolic antioxidant. The results are shown in TABLE 2.

TABLE 2

| % Δ Kinetic Viscosity @ 40° C. | | | | |
|---|---|---|---|---|
| | Time (Hours) | | | |
| | 24.00 | 48.00 | 72.00 | 96.00 |
| HDD with no antioxidant, but with 1 weight percent carbon black: | | | | |
| UNOT # 121 (1) | 0.62 | −12.93 | 15.22 | 120.32 |
| UNOT # 120 (2) | −0.89 | −10.29 | 13.51 | 126.36 |
| HDD with 1 weight percent Durad AX-15 and 1 weight percent carbon black: | | | | |
| UNOT # 155 (2) | 3.95 | 7.36 | 8.38 | 34.14 |
| UNOT # 156 (1) | 2.76 | 6.51 | 6.77 | 30.45 |
| HDD with 1 weight percent DTDTDP and 1 weight percent carbon black: | | | | |
| UNOT # 159 (2) | 1.56 | −9.50 | −0.18 | 48.44 |
| UNOT # 160 (1) | 0.11 | −12.11 | 7.88 | 109.01 |
| HDD with 1.84 weight percent $C_4$—HP:DTDTDP* blend and 1 weight percent carbon black: | | | | |
| UNOT # 161 (2) | 1.93 | 3.49 | 1.72 | 33.61 |
| UNOT # 162 (1) | 4.62 | 6.14 | 4.93 | 35.54 |

*$C_4$—HP is butyl-3-(3,5-di-tert-butyl-4-hydroxyphenyl)propionate and DTDTDP is ditridecylthiodipropionate.

In view of the many changes and modifications that can be made without departing from principles underlying the invention, reference should be made to the appended claims for an understanding of the scope of the protection to be afforded the invention.

What is claimed is:

1. A composition comprising:

A) a lubricant; and

B) a liquid solution of (i) butyl-3-(3,5-di-tert-butyl-4-hydroxyphenyl)propionate, and (ii) ditridecylthiodipropionate;

wherein the ditridecylthiodipropionate comprises greater than 40% by weight of the liquid solution.

2. The composition of claim 1 wherein the lubricant is a lubricating oil.

3. The composition of claim 1 wherein the weight ratio of the butyl-3-(3,5-di-tert-butyl-4-hydroxyphenyl)propionate to the ditridecylthiodipropionate is 45:55.

4. The composition of claim 1 further comprising:

(c) at least one additional additive selected from the group consisting of dispersants, detergents, rust inhibitors, antioxidants, metal deactivators, antiwear agents, antifoamants, friction modifiers, seal swell agents, demulsifiers, VI improvers, and pour point depressants.

5. A composition comprising a lubricant and a liquid antioxidant blend comprising at least a first antioxidant and a second antioxidant, the first antioxidant being butyl-3-(3,5-di-tert-butyl-4- hydroxyphenyl)propionate and the second antioxidant being a dialkylthiodipropionate of the structure:

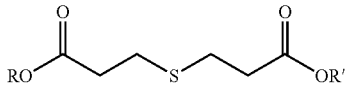

1 wherein R and R' are independently selected from the group consisting of straight chain and branched chain alkyl groups, and wherein the liquid blend comprises at least 40% by weight of the second antioxidant dissolved in the first antioxidant.

6. The composition of claim 5 wherein the lubricant is a lubricating oil.

7. The composition of claim 5 wherein the second antioxidant is ditridecylthiodipropionate.

8. The composition of claim 5 wherein the weight ratio of the first antioxidant to the second antioxidant is 45:55.

9. The composition of claim 5 further comprising at least one additional additive selected from the group consisting of dispersants, detergents, rust inhibitors, antioxidants, metal deactivators, antiwear agents, antifoamants, friction modifiers, seal swell agents, demulsifiers, VI improvers, and pour point depressants.

10. A method of increasing the oxidation stability of a lubricant comprising the steps of:

(A) dissolving a first antioxidant that is butyl-3-(3,5-di-tert-butyl-4- hydroxyphenyl)propionate in a second antioxidant that is a dialkylthiodipropionate of the structure:

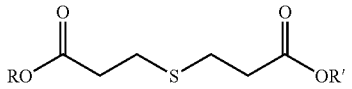

1 wherein R and R' are independently selected from the group consisting of straight chain and branched chain alkyl groups to form a liquid antioxidant blend solution comprising greater than 40% by weight of the second antioxidant, and (B) adding the antioxidant blend solution to the lubricant.

11. The method of claim 10 wherein the lubricant is a lubricating oil.

12. The method of claim 10 wherein the second antioxidant is ditridecylthiodipropionate.

13. The method of claim 10 wherein the weight ratio of the first antioxidant to the second antioxidant is 45:55.

14. The method of claim 10 further comprising at least one additional additive selected from the group consisting of dispersants, detergents, rust inhibitors, antioxidants, metal deactivators, antiwear agents, antifoamants, friction modifiers, seal swell agents, demulsifiers, VI improvers, and pour point depressants.

15. A method of increasing the oxidation stability of a lubricant comprising the steps of:

(A) dissolving butyl-3-(3,5-di-tert-butyl-4-hydroxyphenyl) propionate in ditridecylthiodipropionate to form a liquid antioxidant blend solution comprising greater than 40% by weight of the ditridecylthiodipropionate;

(B) adding the liquid antioxidant blend solution to the lubricant.

16. The method of claim 15 wherein the lubricant is a lubricating oil.

17. The method of claim 15 wherein the weight ratio of the butyl-3-(3,5-di-tert-butyl-4-hydroxyphenyl)propionate to the ditridecylthiodipropionate is 45:55.

18. The method of claim 15 further comprising adding to the lubricant at least one additional additive selected from the group consisting of dispersants, detergents, rust inhibitors, antioxidants, metal deactivators, antiwear agents, antifoamants, friction modifiers, seal swell agents, demulsifiers, VI improvers, and pour point depressants.

* * * * *